US010060088B2

(12) United States Patent
Contant et al.

(10) Patent No.: US 10,060,088 B2
(45) Date of Patent: Aug. 28, 2018

(54) DRIVING ARRANGEMENT AND COOLING SYSTEM FOR A SNOW BLOWER DEVICE

(71) Applicant: GASTON CONTANT INC., Laval (CA)

(72) Inventors: Clement Contant, Laval (CA); Luc Guertin, Saint-Hyacinthe (CA)

( * ) Notice: Subject to any disclaimer, the term of this patent is extended or adjusted under 35 U.S.C. 154(b) by 548 days.

(21) Appl. No.: 14/664,115

(22) Filed: Mar. 20, 2015

(65) Prior Publication Data

US 2016/0273177 A1 Sep. 22, 2016

(51) Int. Cl.

*E01H 5/08* (2006.01)
*F04D 7/00* (2006.01)
*F01P 7/04* (2006.01)

(52) U.S. Cl.

CPC ..... *E01H 5/08* (2013.01); *F01P 7/044* (2013.01); *F04D 7/00* (2013.01)

(58) Field of Classification Search

CPC .. E01H 5/08; E01H 5/04; E01H 5/045; E01H 5/76; E01H 5/09; F04D 7/00; F01P 7/044
USPC ..... 464/74, 75, 76
See application file for complete search history.

(56) References Cited

U.S. PATENT DOCUMENTS 2,764,003 A * 9/1956 Croset ..... F16D 3/68 464/74
2,777,217 A * 1/1957 Klauer ..... E01H 5/04 180/19.1
3,345,831 A * 10/1967 Boole ..... F16D 3/68 464/74
3,583,084 A * 6/1971 Farrell ..... E01H 5/098 37/245
3,620,044 A * 11/1971 Latour ..... F16F 15/10 464/74
4,307,584 A * 12/1981 Sandiumenge ..... F16D 3/68 464/74
4,477,988 A * 10/1984 Vohl ..... E01H 5/098 37/250
4,816,007 A * 3/1989 Box ..... F16D 3/68 464/154
5,209,003 A 5/1993 Maxfield et al.
6,045,448 A * 4/2000 Kern ..... F16D 3/68 464/73

(Continued)

FOREIGN PATENT DOCUMENTS

CA 640135D 4/1962
CA 640135 D 4/1962

(Continued)

*Primary Examiner* — Jamie Louise McGowan
(74) *Attorney, Agent, or Firm* — Benoît & Côté Inc.

(57) ABSTRACT

A driving arrangement for a snow blower device that includes a power source and an impeller, comprises a main body and a drive train within and about the main body. The drive train comprises a right angle gear box in driving engagement with both the power source and the impeller of the snow blower device for transferring torque from the power source to the impeller, thereby driving the impeller of the snow blower device. A cooling system for cooling a main power source configured to drive a snow blower of the snow blower device, comprises an auxiliary power source operatively coupled to the main power source and a fan operatively coupled to the auxiliary power source for cooling the main power source.

6 Claims, 10 Drawing Sheets

(56) References Cited

U.S. PATENT DOCUMENTS

| | | | | |
|---|---|---|---|---|
| 6,131,477 | A * | 10/2000 | Gaydek | F16D 3/68 464/74 |
| 6,358,154 | B1 * | 3/2002 | Murrell | F16D 3/68 464/76 |
| 6,808,455 | B1 * | 10/2004 | Solorenko | F16D 3/12 464/20 |
| 8,291,623 | B2 * | 10/2012 | Shirland | E01H 5/045 37/231 |
| 2001/0008055 | A1 * | 7/2001 | Sueshige | E01H 5/04 37/249 |
| 2002/0142849 | A1 * | 10/2002 | Ash | F16D 3/58 464/87 |
| 2006/0218823 | A1 * | 10/2006 | Olmr | E01H 5/04 37/244 |
| 2007/0049378 | A1 * | 3/2007 | Henderson | F16D 3/68 464/76 |
| 2015/0045125 | A1 * | 2/2015 | Ebert | F16D 3/68 464/75 |
| 2016/0138235 | A1 * | 5/2016 | Friberg | E01H 6/00 37/260 |

FOREIGN PATENT DOCUMENTS

| | | |
|---|---|---|
| CA | 1069546 | 1/1980 |
| CA | 1175076 | 9/1984 |
| CA | 2096260 | 11/1994 |
| CA | 2071355 | 6/1995 |

* cited by examiner

DRIVING ARRANGEMENT AND COOLING SYSTEM FOR A SNOW BLOWER DEVICE

FIELD

The subject matter disclosed generally relates to industrial snow blower devices that are attachable to vehicles such as tractors, trucks, wheel loaders, off road wheel loaders, off road vehicles and the like. More particularly, the subject matter disclosed relates to driving arrangements for industrial snow blower devices, to cooling systems for industrial snow blower devices and to methods of operating such industrial snow blower devices.

INTRODUCTION

Snow blower devices are known on the market as machines that facilitate rapid snow removal. They can be essential for removing snow from driveways, sidewalks, roads, paths and the like. Unlike plows, instead of pushing the snow, snow blowers throw the snow a substantial distance away from the area where it is not wanted, minimizing the accumulation of snow banks. Typically, these snow blowers operate by using a plurality of blades which throws the snow through a chute away from the snow blower.

A variety of snow blower devices exist. In some cases, these devices may be guided by hand and may be sized similar to a walk-behind lawn mower. In other cases, larger versions of these snow blowers are mounted to tractors at the rear, and utilize a power take off shaft that takes power from the engine to drive the snow blower. In yet other scenarios, snow blowers may be mounted to the front of non-tractor vehicles and powered utilizing a power take off shaft.

Front mounted hydraulic snow blowers are often highly expensive to operate and designed for large industrial operations. Further, front mounted hydraulic systems are very difficult to mount and set up, often taking upward of eight hours to install with specialized equipment and skills, and are subject to frequent hydraulic leaking.

Such industrial snow blowers on the marker usually include a power source and a clutch system for operating the drive train which will run the impeller of the snow blower device. For industrial snow blower devices of such dimensions, presence of a clutch system to operate the drive train results in a loss of space in the frame of that snow blower device, in a loss of energy when running the drive train/impeller of that snow blower device, a large number of mechanical components found in the main frame of the snow blower device, an heavy weight of the snow blower device and energy losses (via friction/sliding movements).

Accordingly, the presence of such a clutch system increases fuel consumption and causes wear and tear on the power source of the engine.

There is therefore a need for driving arrangements for snow blower devices that would overcome the drawbacks presented above for driving arrangements of industrial snow blower devices.

Additionally, the engine included in such industrial snow blower devices are often known as diesel engines. These diesel engines now on the market (the ones on the market that are not only provided for the snow blowing purposes) are provided with turbo systems of which air needs to be cooled before being provided to the engine air intake. Because snow blowing operations take place during cold periods of the year, the cooling needs for snow blower devices during snow blowing operations are often less than what is required by the engine manufacturers. Therefore, cooling the diesel engine requires a certain amount of energy, which energy is taken from the energy that could have been used for driving the actual impeller or snow blower of the snow blower device (using the driving arrangement).

There is therefore a need for alternative systems so that the energy can be optimizedly provided to both the cooling system and the driving arrangement of a snow blower device.

SUMMARY

According to an embodiment, there is provided a driving arrangement for a snow blower device comprising a power source and an impeller, the driving arrangement comprising:

a main body;

a drive train within and about the main body comprising:

a right angle gear box in driving engagement with both the power source and the impeller of the snow blower device for transferring torque from the power source to the impeller, thereby driving the impeller of the snow blower device.

According to another embodiment, there is provided a cooling system for cooling a main power source configured to drive a snow blower of a snow blower device comprising:

an auxiliary power source operatively coupled to the main power source; and a fan operatively coupled to the auxiliary power source for cooling the main power source.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DESCRIPTION OF VARIOUS EMBODIMENTS

In embodiments, there are disclosed a snow blower device, a driving arrangement for the snow blower device, a cooling system for the snow blower device and a method for operating the same.

Figure 1:
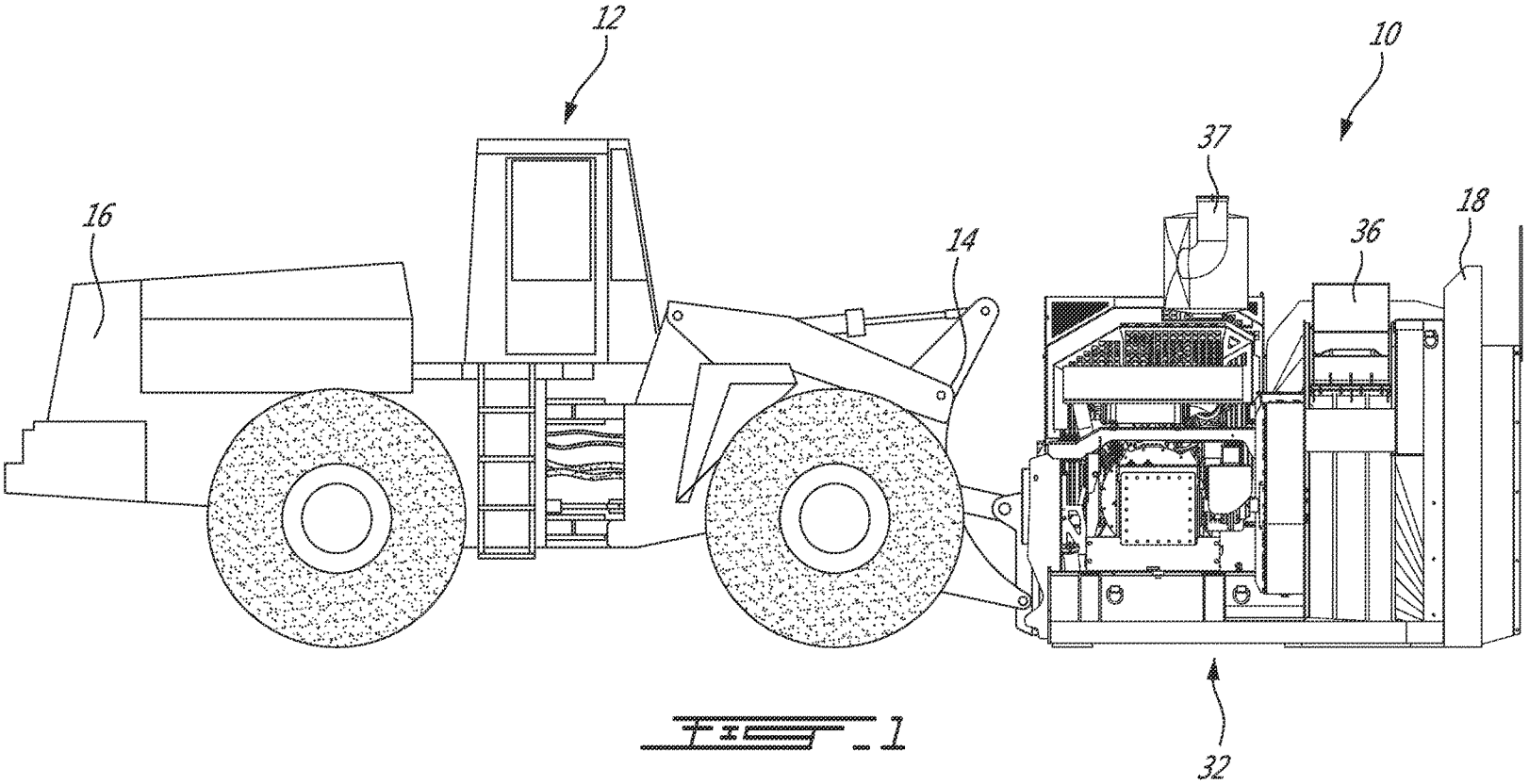
FIG. 1 is a side elevation view of a snow blower device mounted on the front of a vehicle in accordance with an embodiment.

Referring now to the drawings, and more particularly to FIG. 1, there is shown a snow blower device 10 mounted on the front 14 of a vehicle 12. The vehicle 12 may be a tractor, a truck, a wheel loader, an off road wheel loader, an off-road vehicle and the like. The snow blower device 10 is an independently driven snow blower device or attachment. Even if the snow blower device 10 is shown in FIG. 1 as being mounted on the front 14 of the vehicle 12, it is to be mentioned that the snow blower device 10 may optionally be mounted on the rear 16 of the vehicle 12. The main role of the vehicle 12 equipped with the front mounted snow blower device 10 is to throw the snow a substantial distance away from the area where it is not wanted, for minimizing the accumulation of snow banks during large industrial operations.

Figure 2:
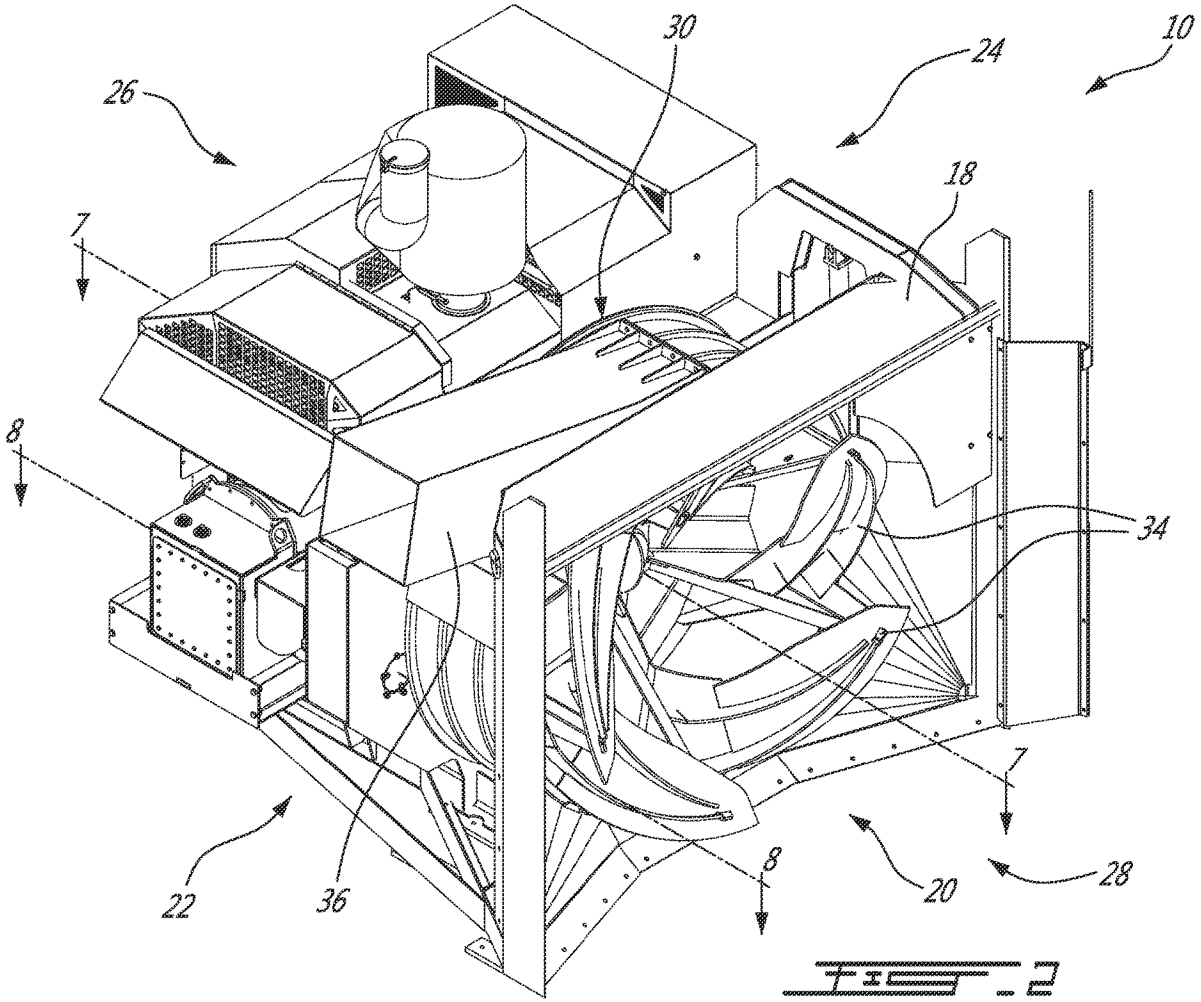
FIG. 2 is a top perspective view of the snow blower device of FIG. 1.
Figure 3:
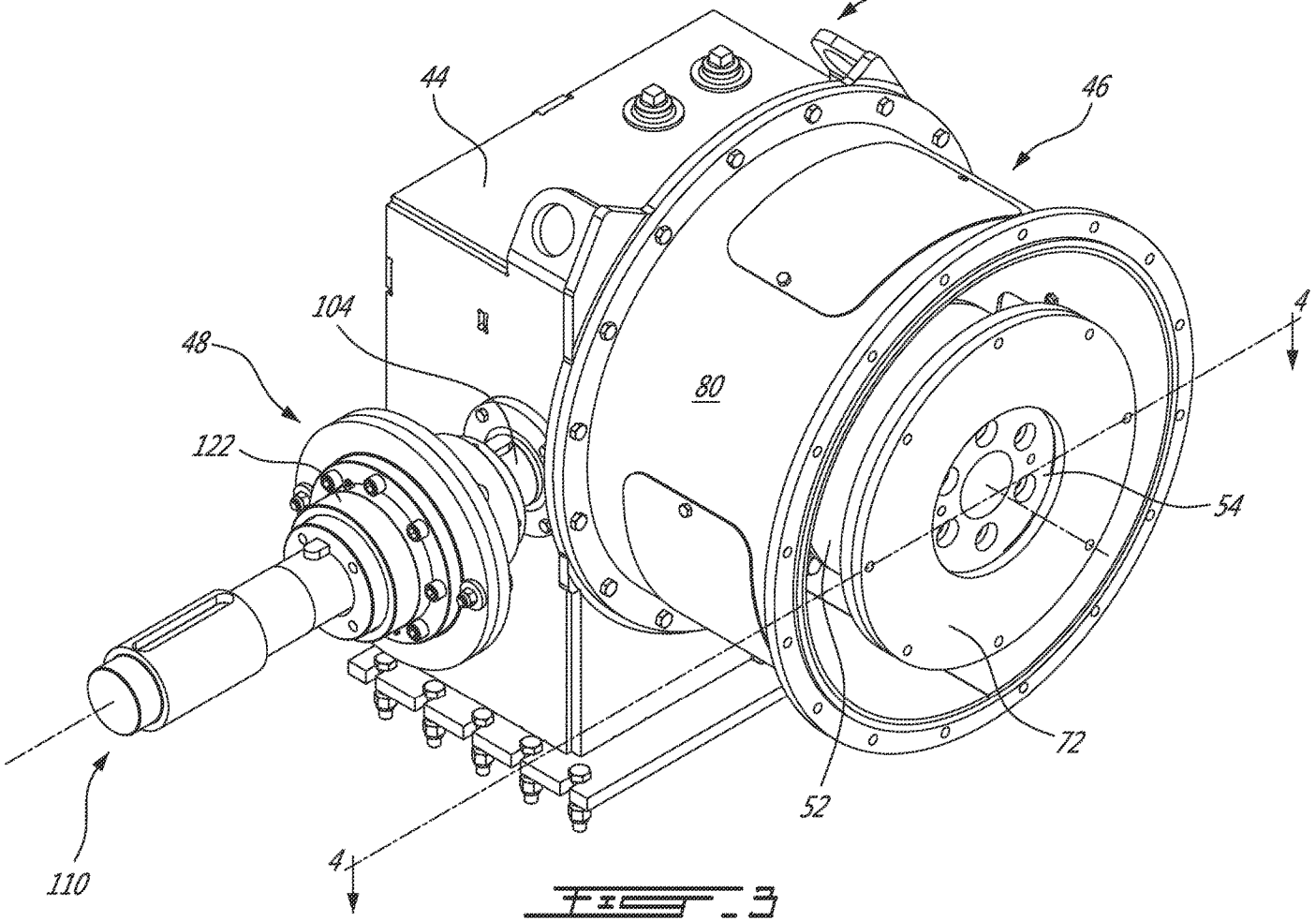
FIG. 3 is a top perspective view of a driving arrangement of the snow blower device of FIG. 2.

Referring now to FIGS. 1 and 2, there is shown that the snow blower device 10 includes a main frame 18 which forms a snow capturing cavity 20 (FIG. 2) in a manner that is well known in the snow removal art. The main frame 18 defines sides 22, 24, rear 26, front 28, top 30 and bottom 32 (FIG. 1) which define the base structure for the snow blower device 10. The front 28 of the main frame 18 defines the snow capturing cavity 20 (FIG. 2). The snow moving components of the main frame 18 may include those components typical of any snow blower device including, but not limited to, a plurality of internal blades 34, a snow chute 36 and an exhaust 37.

As shown in FIG. 2, the plurality of internal blades 34 includes five concave blades 34. The concave blades 34 may be made of a steel wear plate material, or any other suitable material that is resistant for such industrial operations. It is to be mentioned that any other suitable blades or impeller may be used, according to the actual state of the art in the snow removal/blower industry.

The main frame 18 may further include an engine receiving section (not shown) constructed and arranged to receive a power source or engine (not shown). The engine may include any source of motive power and may include gasoline engines, propane engines, diesel engines, electrical engines or any similar self-contained motive source of power. The engine may be a self-contained engine which itself may be electric start for operation via electrical wiring from the vehicle operator's seat. The main frame 18 is constructed and arranged such as to facilitate installation and removable connection of the snow blower device 10 with the front 14 (or alternatively the rear 16) of the vehicle 12.

Figure 7:
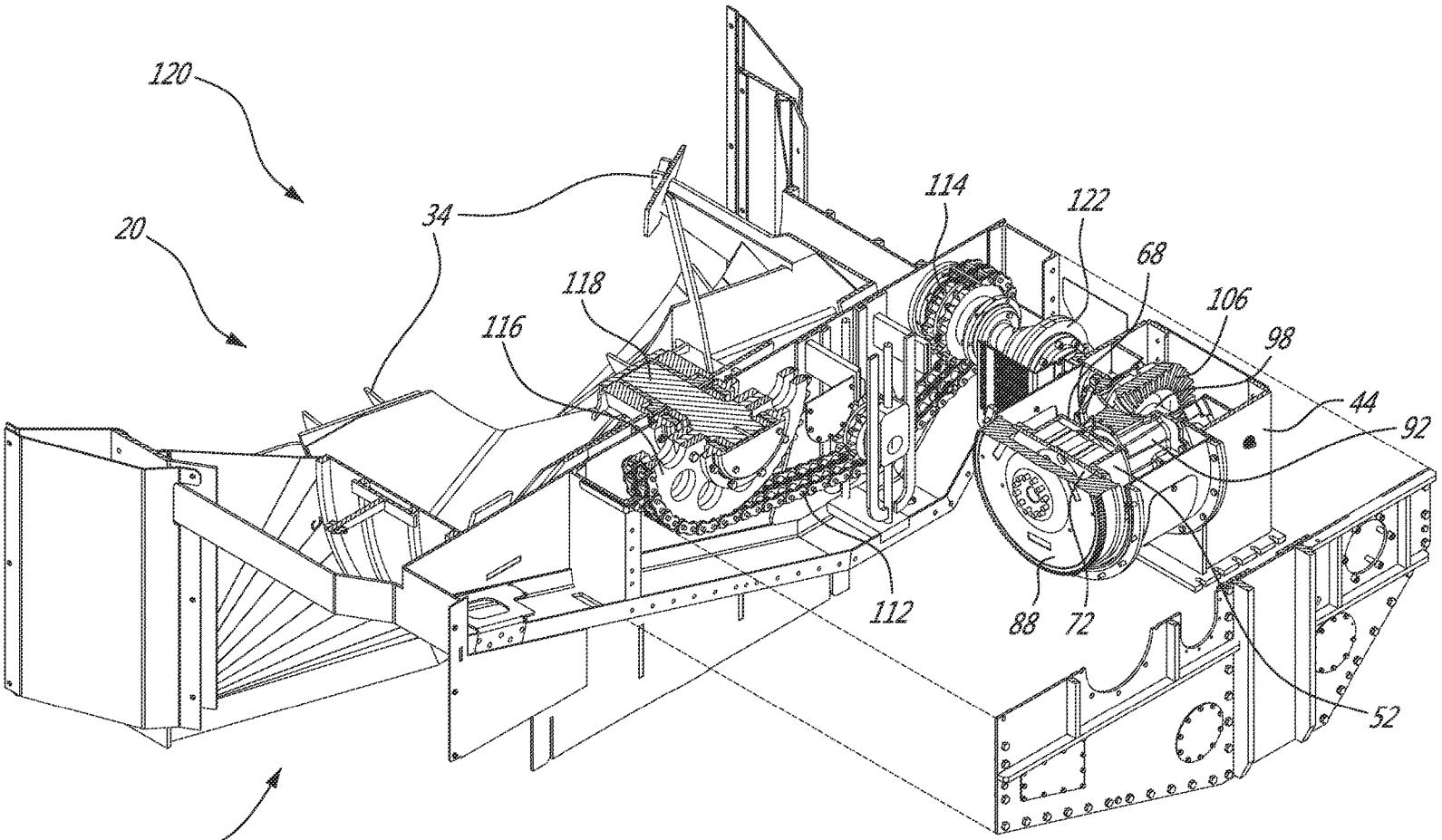
FIG. 7 is a cross-sectional view taken along line 7-7 of the snow blower device of FIG. 2.
Figure 8:
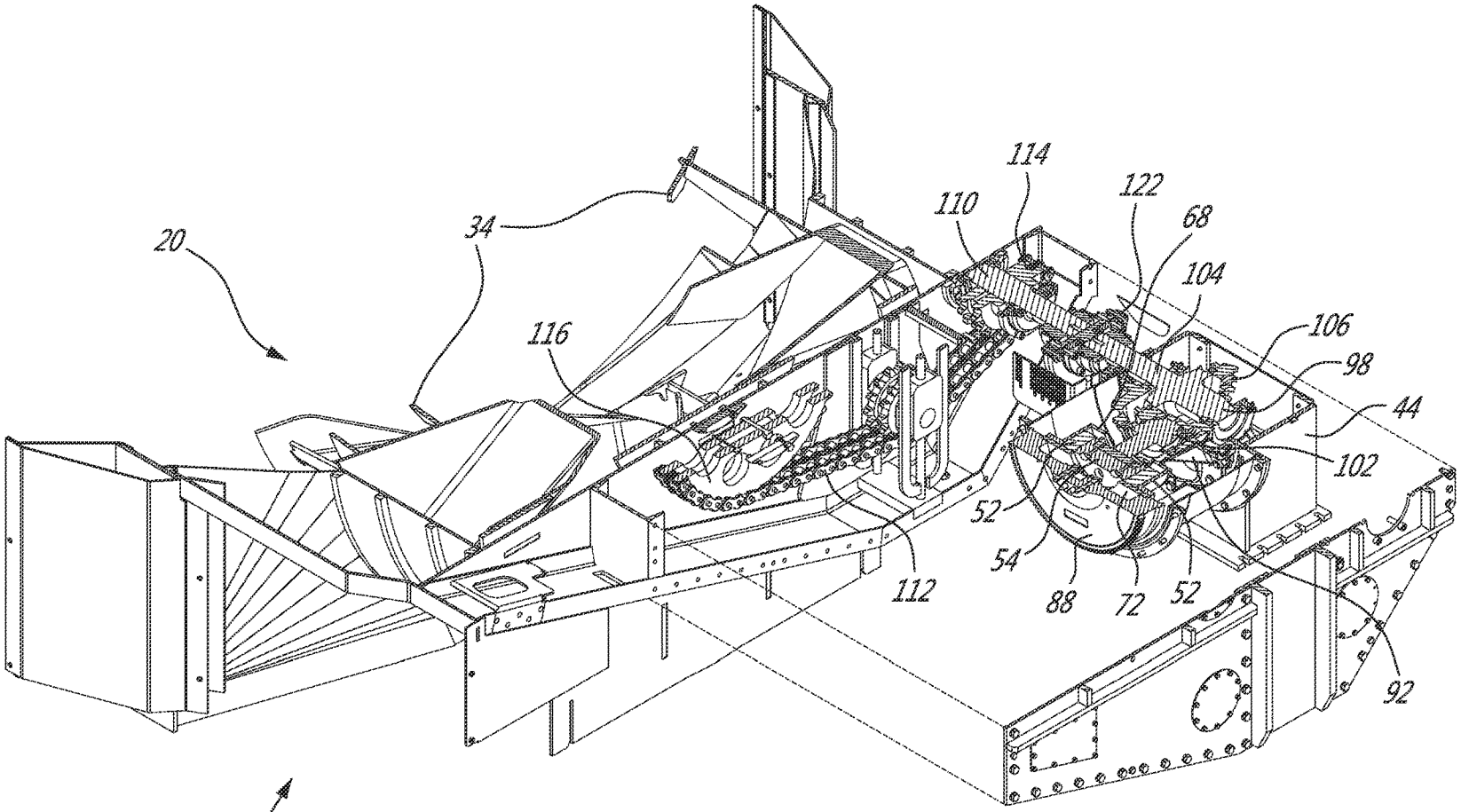
FIG. 8 is a cross-sectional view taken along line 8-8 of the snow blower device of FIG. 2.
Figure 9:
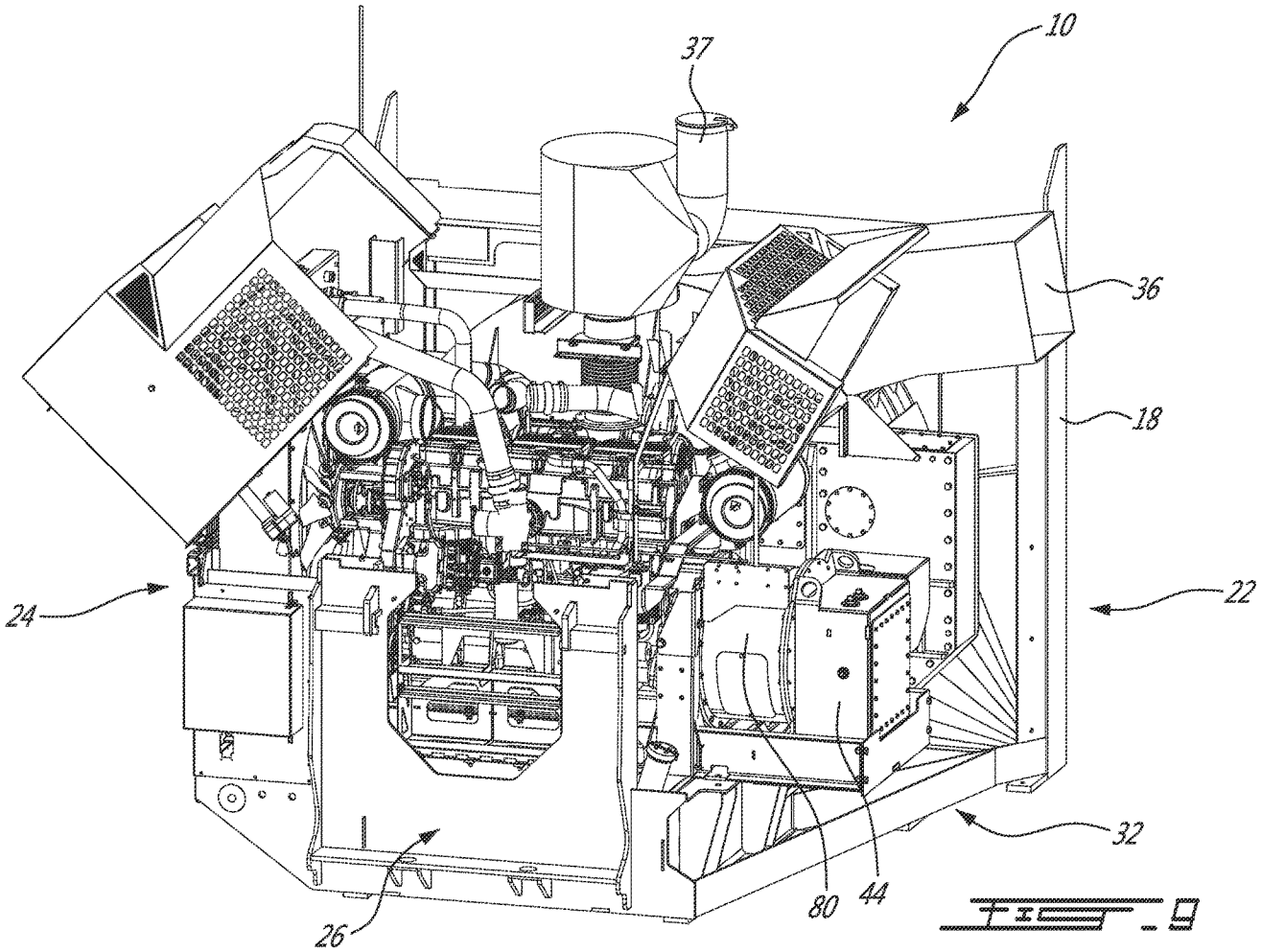
FIG. 9 is a top perspective view of the snow blower device of FIG. 2, showing its interior.

As better shown in FIG. 7, the engine is employed to mechanically drive the plurality of internal blades 34 (or the impeller/blower 120) via a driving arrangement 42 as it will be described in more details below.

Figure 4:
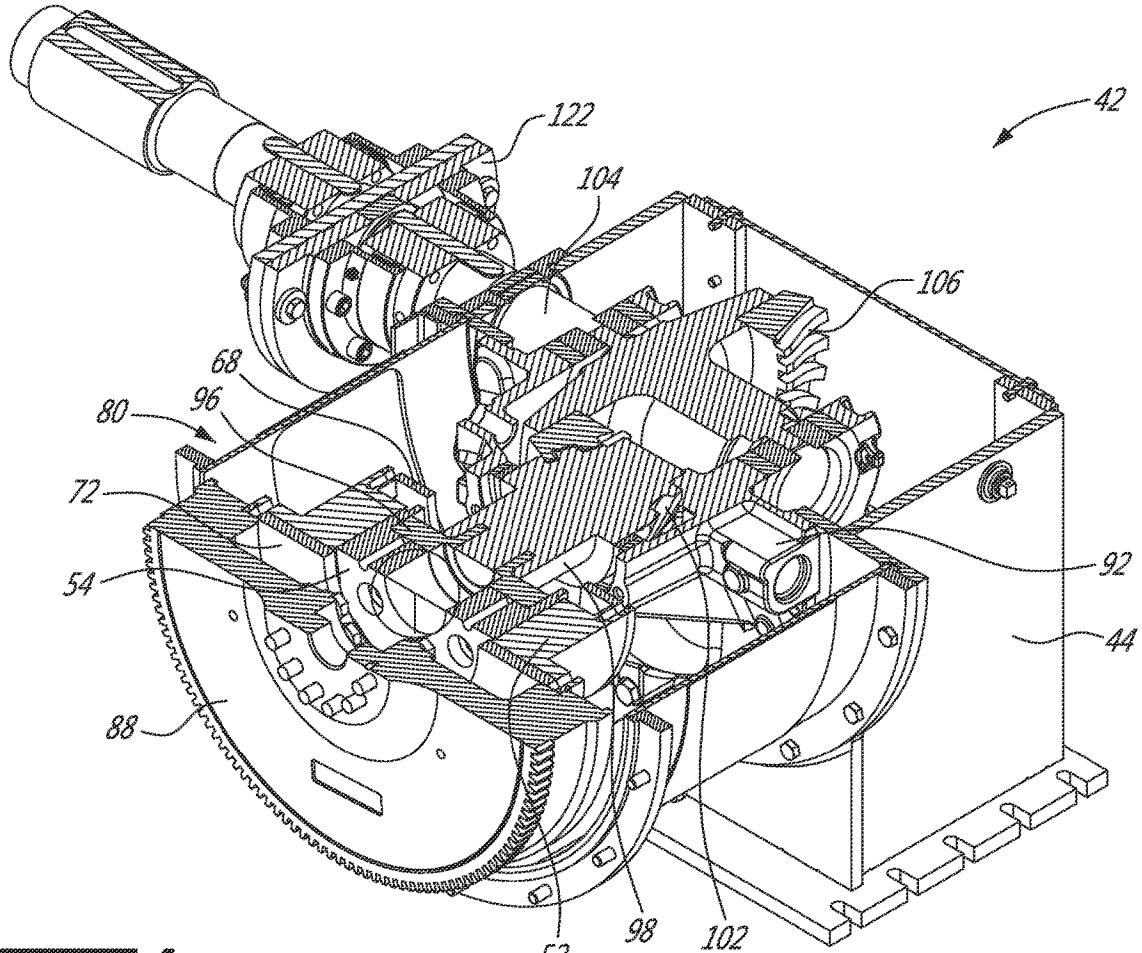
FIG. 4 is a cross-sectional view taken along line 4-4 of the driving arrangement of FIG. 3.
Figure 5:
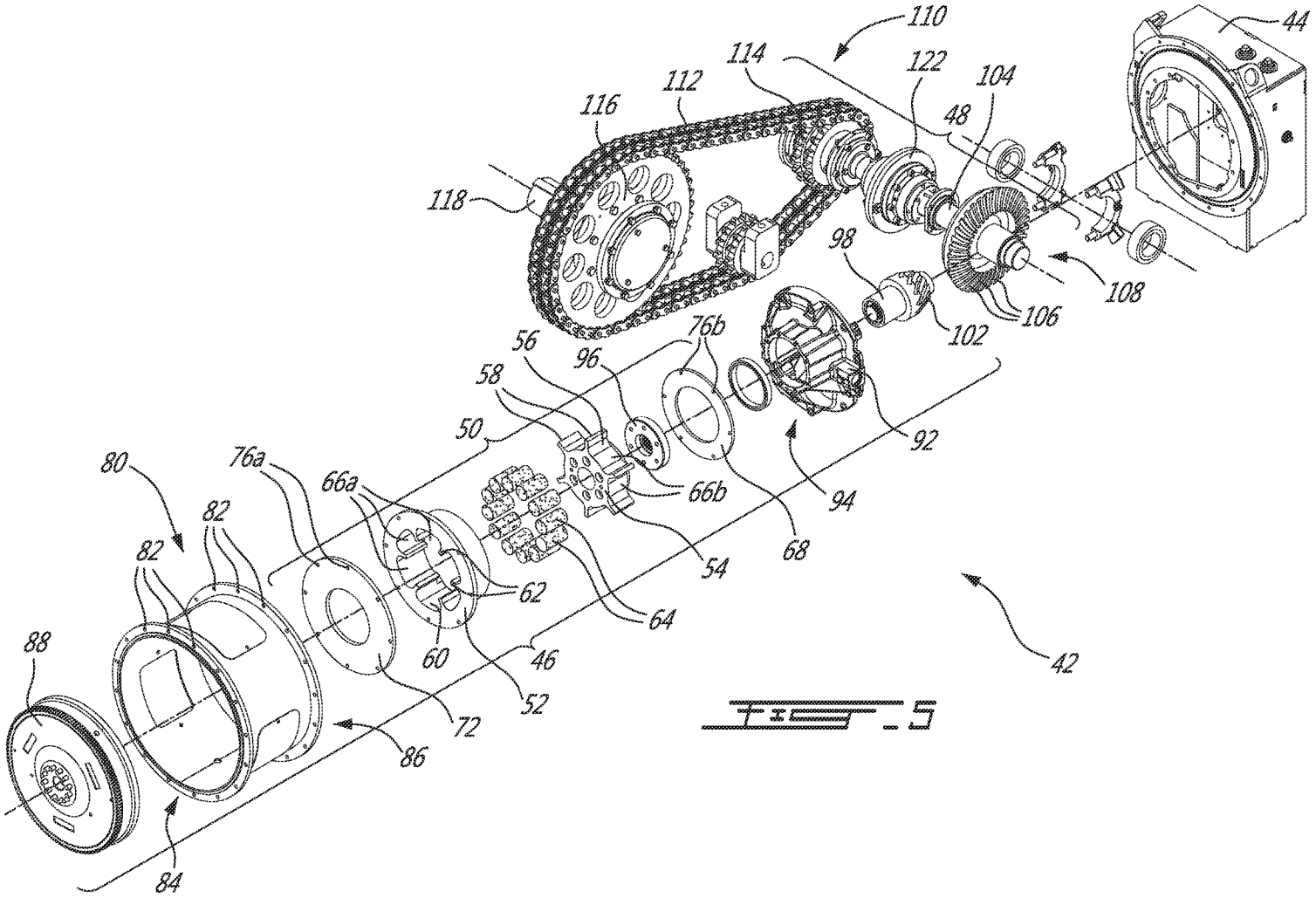
FIG. 5 is an exploded view of the driving arrangement of FIG. 3.
Figure 6:
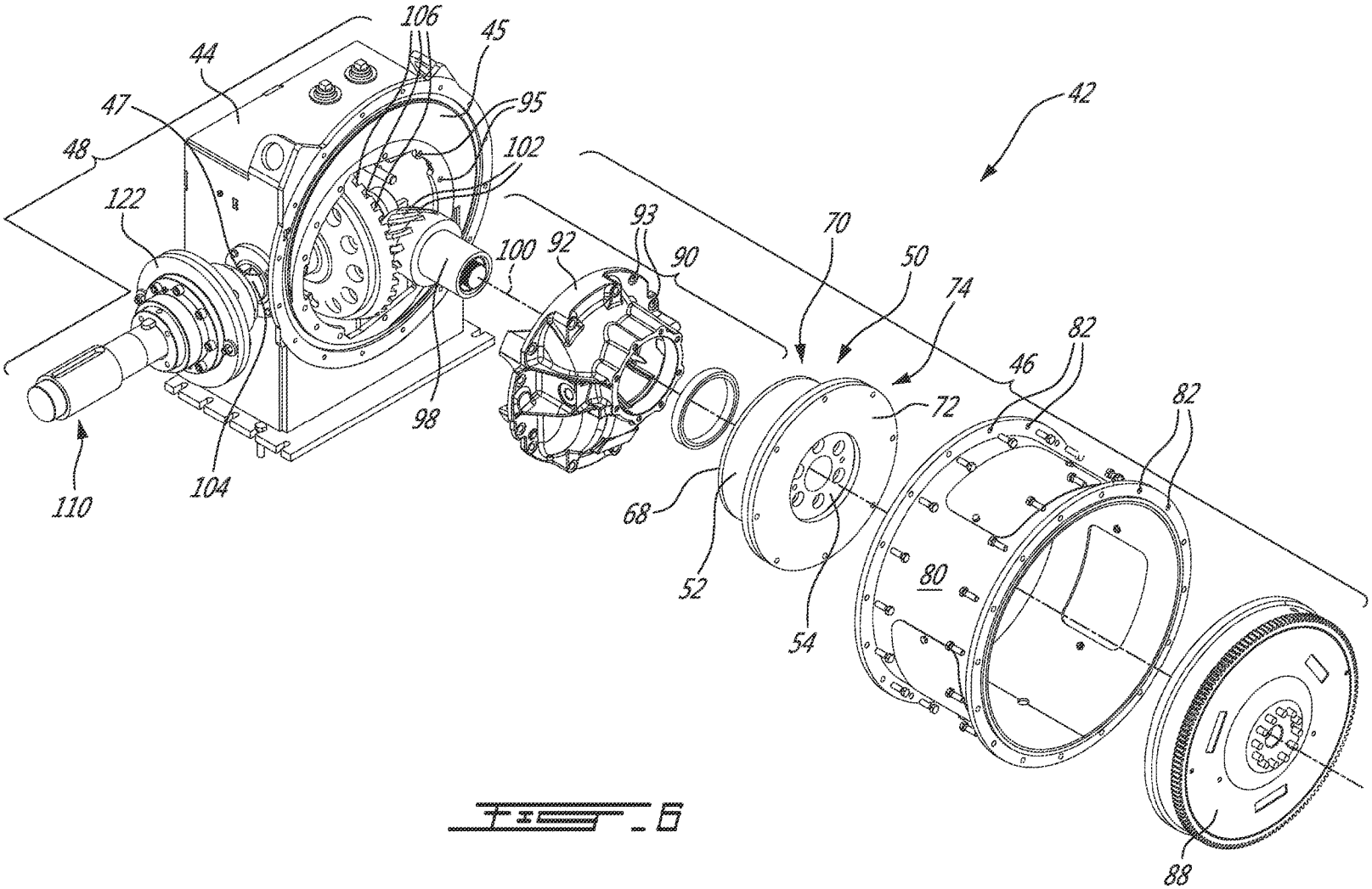
FIG. 6 is another exploded view of the driving arrangement of FIG. 3.

Now referring to FIGS. 3-8, there is shown the driving arrangement 42 in better details. The driving arrangement 42 is in driving engagement with the engine of the snow blower device 10 and the internal blades 34 of the impeller 120 as it will be described in more details below. The driving arrangement 42 includes a main body 44, an engine engaging arrangement 46 mounted on the main body 44 and a blower engaging arrangement 48 mounted on and about the main body 44 and in a substantially perpendicular driving engagement with the engine engaging arrangement 46. As shown, the main body 44 includes a main opening 45 on one of its faces and a secondary opening 47 on an adjacent one of its faces (FIG. 6). The main opening 45 of the main body 44 is for receiving the engine engaging arrangement 46 while the secondary opening 47 of the main body is for receiving the blower engaging arrangement 48. The main opening 45 is therefore perpendicular to the secondary opening 47 of the main body 44, as the engine engaging arrangement 46 is substantially perpendicular to the blower engaging arrangement 48.

The engine engaging arrangement 46 includes a compression coupling device 50. As better shown in FIG. 5, the compression coupling device 50 includes a female portion 52 and a male portion 54 which is fitted inside the female portion 52 (FIG. 6). The male portion 54 defines a circular outer edge 56 and a plurality of outward projections 58 outwardly extending from the circular outer edge 56 of the male portion 54. The female portion 52 defines a circular inner edge 60 and a plurality of inward projections 62 inwardly extending from the circular inner edge 60. A plurality of resilient/flexible portions (or blocks) 64 (i.e., such as rubber portions or any other portions of suitable materials that would provide shock absorption between the female and male portions 52, 54) are placed in the spaces 66*a*, 66*b* between the inward projections 62 of the female portion 52 and the outward projections 58 of the male portion 54 respectively.

Therefore, as the female portion 52 is driven by the engine (not shown), it drives the male portion 54 through the plurality of resilient/flexible portions 64. As it happens, the plurality of resilient/flexible portions 64 are compressed. According to the configuration of the compression coupling device 50 which includes the male portion 54 that is fitted in the female portion 52 and as each one of the plurality of outward projections 58 of the male portion 54 and each one of the plurality of inward projections 62 of the female portion 52 are separated by one resilient/flexible portion 64, resonant torsional vibrations of the snow blower device 10 may be decreased, severe shock load protection may be increased, maintenance time periodicity may be increased, noise may be attenuated and the like.

The compression coupling device 50 further includes a first ring 68 mounted on one side 70 of the male portion 54 fitted in the female portion 52 and a second ring 72 mounted on the other side 74 of the male portion 54 fitted in the female portion 52. The first and second rings 68, 72 are provided for keeping the male portion 54 within the female portion 52 when the engine drives both the female and male portions 52, 54 to rotate. As better shown in FIG. 5, each one of the first and second rings 68, 72 includes a plurality of holes 76*a*, 76*b* on their respective periphery for fastening the first and second rings 68, 72 to the female portion 52, which also includes a plurality of corresponding holes on the periphery of both its sides (best shown in FIG. 6) using a plurality of fasteners (not shown).

The engine engaging arrangement 46 further includes a flywheel housing 80 for receiving, at least, the compressing coupling device 50, which itself includes the female portion 52, the male portion 54 fitted within the female portion 52 with the plurality of resilient/flexible portions 64 and the first and second rings 68, 72. One objective of the flywheel housing 80 is to receive, while aligning, the female portion 52, the male portion 54 fitted within the female portion 52 with the plurality of resilient/flexible portions 64 and the first and second rings 68, 72 just mentioned above.

The flywheel housing 80 defines a cylindrical shape for receiving the compression coupling device 50 parts, which are also substantially circular in shape (i.e., the female portion 52, the male portion 54 fitted within the female portion 52 with the plurality of resilient/flexible portions 64 and the first and second rings 68, 72). The flywheel housing 80 also includes a plurality of holes 82 on the periphery of both of its sides 84, 86.

The engine engaging arrangement 46 further includes a flywheel 88 which is fixedly mounted on the first ring 68 and which is in driving arrangement with the engine (not shown). The flywheel 88 is adjacent to side 84 of the flywheel housing 80 (FIG. 4). Therefore, the engine driving the flywheel 88 that is adjacent the flywheel housing 80 will allow the male portion 54 fitted within the female portion 52 to rotate (both male portion 54 and female portion 52 are in rotation) as the flywheel 88 is fixedly mounted on the second ring 72. As for the flywheel housing 80, it will remain fixed relative to the main body 44 of the driving arrangement 42.

The engine engaging arrangement 46 further includes a direction gear arrangement 90. The direction gear arrangement 90 is partly received in the flywheel housing 80. The direction gear arrangement 90 includes a direction gear main frame 92 connected on its side 94 to a direction gear ring 96, which is located within the compression coupling device 50. The direction gear main frame 92 defines a hollow opening for receiving a geared shaft 98 which is fixedly connected to the direction gear ring 96. Therefore, as the direction gear ring 96 is being connected to the male portion 54, when the male portion 54 is in rotation about axis 100 (FIG. 6), the direction gear ring 96 rotates as well and drives the geared shafted 98 which passes through the hollow opening defined in the direction gear main frame 92. The geared shaft 98 includes a plurality of cut teeth or bevelled gears 102 that will mesh with another toothed or geared part of the blower engaging arrangement 48, which is in a perpendicular driving arrangement/engagement with the engine engaging arrangement 46, to receive torque from the engine engaging arrangement 46, as it will be described in more details below. The direction gear main frame 92 includes a plurality of holes 93 and will be fixedly connected about the main opening 45 of the main body 44 via these holes 93 and using corresponding holes 95 positioned on the main body 44 of the driving arrangement 42.

Still referring to FIGS. 3 to 8, on the other hand, the blower engaging arrangement 48 is partly received within the main body 44 of the driving arrangement 42. The blower engaging arrangement 48 includes a geared shaft 104 that meshes or cooperates with the geared shaft 98, and more particularly with the cut teeth or bevelled gears 102, of the engine engaging arrangement 46. The geared shaft 104 is received within the main body 44 via the secondary opening 47 of the main body 44. The geared shaft 104 is substantially perpendicular to the geared shaft 98. The geared shaft 104 includes a plurality of cut teeth or bevelled gears 106 that meshes with the cut teeth/bevelled gears 102 at its end 108. As shown in FIG. 5, at its opposite end 110, the geared shaft 104 will receive the driving chain 112 which is supported by a first geared wheel 114 and a second geared wheel 116. The first geared wheel 114 receives end 110 of the geared shaft 104. The first geared wheel 114 thus rotates about the axis defined by the geared shaft 104. On the other hand, the second geared wheel 116, which has a diameter that is greater than the diameter of the first geared wheel 114, receives the blower shaft 118. The second geared wheel 116 thus rotates about the axis defined by the blower shaft 118.

According to the configuration of the driving arrangement 42 defined above of the snow blower device 10, which includes the engine engaging arrangement 46 which is substantially perpendicular to the blower engaging arrangement 48, there is provided power to the blower shaft 118 (and thus to the impeller or blower 120) while minimizing the power losses. According to the configuration of the driving arrangement 42, there is no need for a clutch system. In replacement to a clutch system, providing the engine engaging arrangement 46 substantially perpendicular (i.e., right angle gear box) to the blower engaging arrangement 48 will reduce the rotational speed provided by the engine to the engine engaging arrangement 46 according to a predetermined ratio (i.e., diameter of geared portion of the geared shaft 98/diameter of geared portion of the geared shaft 104 or number of cut teeth/bevelled gears 102 of geared shaft 98/number of cut teeth/bevelled gears 106 of geared shaft 104). The snow blower device 10 including the driving arrangement 42 as described above (and without presence of a clutch system) reduces the number of parts that are needed within the main frame 18 of the snow blower device 10 and therefore minimize the associated weight, the associated energy losses (friction losses and sliding losses) and maximize the volume available within the main frame 18 of the snow blower device 10.

According to an embodiment, the dimensions of the snow blower device 10 may be as follows: cutting width: 3073 mm; overall length: 3242 mm; length from fixing plate: 3092 mm; overall height: 2604 mm; working height: 2254 mm; weight: 11 068 kg. It is however to be mentioned that the snow blower device 10 may include any suitable dimensions and configurations.

According to an embodiment, the capacity of the snow blower device 10 may be as follows: capacity: up to 10 000 tons/hour depending on engine selection; casting distance: up to 91 m depending on the ratio selection. It is however to be mentioned that the snow blower device 10 may be customized to provide any suitable capacity.

According to an embodiment, the impeller/blower 120 may include the specifications as follows: diameter: 2032 mm; Blades: Five concave blades in steel wear plate; impeller casing: made of steel wear plate; hydraulic rotation with hydraulic cylinder from the third loader valve. It is however to be mentioned that the snow blower device 10 may include any suitable impeller/blower 120 that can be driven by the driving arrangement 42 as described above. Hydraulic rotation may be provided with a hydraulic cylinder from a third loader valve or via a hydraulic circuit added on the snow blower device 10.

According to an embodiment, the power unit or engine of the snow blower device 10 may include, without limitation, a diesel engine L6 (700 bhp at 2100 rpm); a diesel engine L6 (800 bhp at 2100 rpm); a diesel engine V12 (1 150 bhp at 2100 rpm); a diesel engine V12 (1 350 bhp at 2100 rpm) and the like. It is however to mentioned that any suitable power unit or engine may be used to drive the driving arrangement 42 described above.

According to an embodiment, the drive chain or roller chain 112 may be in a fully enclose oil bath.

According to an embodiment, the snow blower device 10 may include shear bolts 122 mounted on the blower engaging arrangement 48 of the driving arrangement 42.

According to an embodiment, the engine may be a Caterpillar C18—800 hp.

Figure 10:
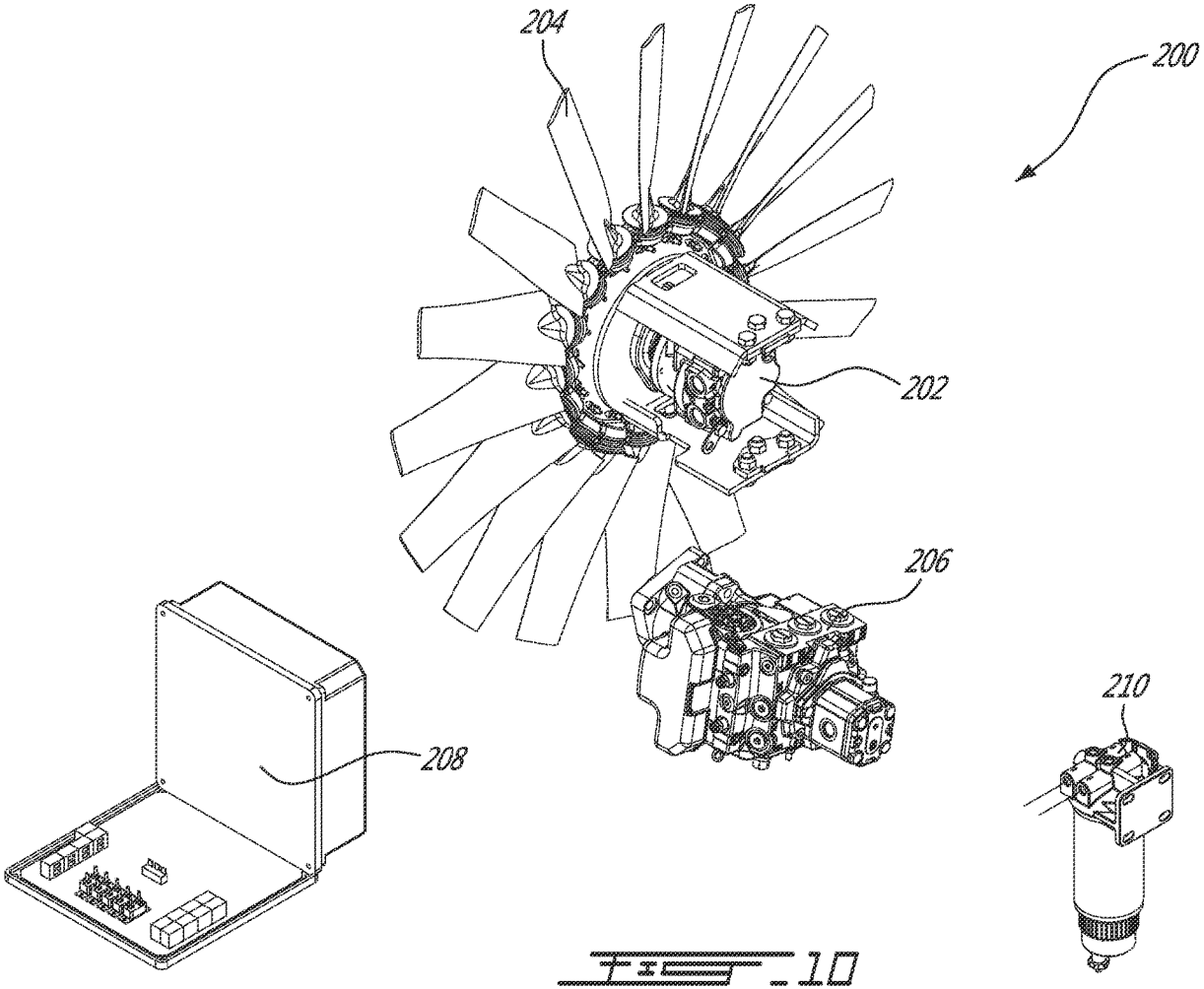
FIG. 10 is a top perspective view of a cooling system in accordance with another embodiment.

According to another embodiment and referring now to FIG. 10, there is shown a cooling system 200 for cooling the main power source (mentioned above) which is configured to drive the snow blower 120 of the snow blower device 10. The cooling system 200 includes an auxiliary power source 202 (i.e., hydraulic motor) which is operatively coupled to the main power source (not shown) and a fan 204 which is operatively coupled to the auxiliary power source 202 for cooling the main power source (not shown).

Still referring to FIG. 10, there is shown that the cooling system 200 further includes a hydrostatic pump 206 operatively coupled between the secondary power source 202 (i.e., hydraulic motor) and the main power source.

According to one embodiment, the main power source may be a diesel engine and the auxiliary power source 202 may be a hydraulic fixed displacement piston motor.

According to one embodiment, the pump 206 of the cooling system 200 may be a reversible hydrostatic pump.

The cooling system 200 may further include a controller 208 for operably controlling the auxiliary power source 202, and thus the fan 204 only when needed, depending on predetermined criteria, such as, without limitation, temperature of the main power source and/or temperature of the auxiliary power source 202. Therefore, the main power source and alternatively the auxiliary power source 202 may be equipped with temperature indicators, and may be operatively coupled to the controller 208. As shown in FIG. 10, the cooling system 200 may further include an oil reservoir for providing oil to the hydraulic pump 206 and an oil filter 210, such as a diesel filter. Rotation direction and/or rotation speed of the fan 204 may be controlled by the temperature of air at the entrance and by the temperature of the freezing liquid of the diesel engine. Control may include a time delay in order not to follow each and every heat peak (more particularly heat peaks of air).

According to another embodiment, there is provided a method for cooling the main power source configured to drive the snow blower 120 of the snow blower device 10 described above. The method includes the step of providing the auxiliary power source 202 to drive the fan 204 which is responsible of cooling the main power source (not shown).

According to one embodiment, the method may include the step of providing the auxiliary power source 202 to drive the fan 204 only when temperature of the main power source needs to be decreased or cooled.

According to one embodiment, the method may include the step of providing the auxiliary power source 202 to drive the fan 204 in a first rotation direction and/or in a second rotation direction (and/or at different rotational speeds).

According to one embodiment, the method may further include the step of obtaining the temperature of the main power source (and alternatively the auxiliary power source 202) prior providing the auxiliary power source 202 (and alternatively the auxiliary power source 202) to drive the fan 204 responsible of cooling the main power source.

According to the configuration of the cooling system 200, the auxiliary power source 202 and its corresponding fan 204 are responsible of cooling the main power source (mainly antifreeze and air). Because snow blowing operations take place during cold periods of the year, the cooling needs for the snow blower device 10 during snow blowing operations are less than what is required by the main power source manufacturer (operations performed during summer time for example). Therefore, according to the configuration of the cooling system 200, cooling the diesel engine requires a certain amount of energy, which energy is taken from the auxiliary power source 202 instead of energy from the main power source that is used for driving the actual impeller or snow blower 120 of the snow blower device 10 (using the driving arrangement). The energy provided by the main power source may then be used only to drive the driving arrangement 24, and not for cooling purposes. The global efficacy of the snow blower device 10 is then increased.

As the main power source is optimizedly cooled and/or heated, less ice/snow/debris will accumulate on the radiator of the main power source. Needs for maintenance and/or washing the radiator of the main power source are then decreased and operator of such snow blowing devices 10 will lose less time in performing such operations.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A driving arrangement for a snow blower device comprising a power source and an impeller, the driving arrangement comprising:

a main body;

a drive train within and about the main body comprising:

a right angle gear box in driving engagement with both the power source and the impeller of the snow blower device for transferring torque from the power source to the impeller, thereby driving the impeller of the snow blower device;

wherein the right angle gear box comprises:

an engine engaging arrangement mounted on the main body and in driving arrangement with the power source; and a blower engaging arrangement mounted on and about the main body and in a right angle driving engagement with the engine engaging arrangement for driving the impeller;

wherein the engine engaging arrangement comprises a compression coupling device comprising:

a female portion defining a circular inner edge and a plurality of inward projections extending therefrom;

a male portion fitted inside the female portion, the male portion defining a circular outer edge and a plurality of outward projections outwardly extending therefrom; and a plurality of flexible portions, each one of the plurality of flexible portions being inserted between an outward projection and an adjacent inward projection of the male portion fitted inside the female portion;

wherein the compression coupling device further comprises:

a first ring mounted on one side of the male portion fitted in the female portion; and a second ring mounted on another side of the male portion fitted in the female portion, the second ring being in driving engagement with the power source;

wherein the engine engaging arrangement further comprises a flywheel operatively coupled to the power source, the flywheel being fixed to the second ring, thereby providing the male portion fitted in the female portion to rotate upon rotation of the flywheel; and and wherein the driving arrangement further comprises a direction gear arrangement operatively connected to the compression coupling device, the direction gear arrangement comprising:

a direction gear main frame defining a hollow opening;

a direction gear ring about the direction gear frame and mounted in the compression coupling device between the first ring and the male portion fitted in the female portion; and a first geared shaft received in the hollow opening of the direction gear main frame and in driving arrangement with the direction gear ring, the first geared shaft being capable of rotation about a first rotation axis, wherein when the male portion fitted in the female portion rotates about the first rotation axis, the direction gear ring is driven to rotate about the first rotation axis, thereby causing the first geared shaft to rotate and to mesh with an end of the blower engaging arrangement, thereby driving the impeller of the snow blower device.

2. The driving arrangement of claim 1, wherein the main body comprises a main opening on one of its faces for receiving the engine engaging arrangement and a secondary opening on an adjacent one of its faces for receiving the blower engaging arrangement, the blower engaging arrangement comprising:

a second geared shaft receiving within the secondary opening being capable of rotation about a second rotation axis perpendicular to the first rotation axis, the second geared shaft meshing with an end of the first geared shaft for driving the impeller.

3. The driving arrangement of claim 2, wherein the first geared shaft comprises a first set of beveled gears arranged thereon and wherein the second geared shaft comprises a second set of beveled gears arranged thereon.

4. The driving arrangement of claim 3, wherein the number of beveled gears of the second set is greater than the number of gears on the first set.

5. The driving arrangement of claim 4, wherein the blower driving arrangement further includes a plurality of shear bolts arranged on the second geared shaft.

6. The driving arrangement of claim 5, wherein the other end of the second geared shaft is for driving engagement with a drive chain driving the impeller of the snow blower.

* * * * *